US008397827B2

(12) United States Patent
Ringgenberg

(10) Patent No.: US 8,397,827 B2
(45) Date of Patent: Mar. 19, 2013

(54) REDUCING TRIPS IN WELL OPERATIONS

(75) Inventor: Paul D. Ringgenberg, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/369,676

(22) Filed: Feb. 9, 2012

(65) Prior Publication Data

US 2012/0312529 A1 Dec. 13, 2012

(51) Int. Cl.
*E21B 23/00* (2006.01)

(52) U.S. Cl. ..... 166/382; 166/85.4; 166/77.1; 166/83.1

(58) Field of Classification Search ..... 166/85.4, 166/208, 77.1, 89.3, 83.1, 382
See application file for complete search history.

(56) References Cited

U.S. PATENT DOCUMENTS

| | | | | |
|---|---|---|---|---|
| 3,489,439 | A * | 1/1970 | Word, Jr. | 285/123.9 |
| 4,310,048 | A | 1/1982 | Mott | |
| 4,597,454 | A | 7/1986 | Schoeffler | |
| 5,620,052 | A * | 4/1997 | Turner | 166/348 |
| 6,557,644 | B1 * | 5/2003 | Miller et al. | 166/382 |
| 2003/0111228 | A1 | 6/2003 | Garrett et al. | |
| 2006/0219413 | A1 * | 10/2006 | Vilela et al. | 166/381 |
| 2008/0121429 | A1 | 5/2008 | Bamford | |
| 2009/0229830 | A1 * | 9/2009 | Kerr | 166/336 |
| 2009/0260829 | A1 * | 10/2009 | Mathis | 166/336 |

OTHER PUBLICATIONS

Search Report issued Jan. 6, 2012 for International Application No. PCT/US11/39841, 5 pages.

Written Opinion issued Jan. 6, 2012 for International Application No. PCT/US11/39841, 4 pages.

International Search Report with Written Opinion issued Jan. 6, 2012 for PCT Patent Application No. PCT/US11/039841, 9 pages.

EXPRO; "Well Integrity: Combined Caliper and video (CalVid)", Well Flow Management, received May 19, 2011, 2 pages.

Stuart McAleese; "Operational Aspects of Oil and Gas Well Testing", informational paper Chapter 12, dated 2000, 11 pages.

EXPRO; "Subsea Saftey Systems: ELSA-EA Adjustable Fluted Hanger Assembly", Well Flow Management, received May 19, 2011, 2 pages.

Halliburton Energy Services Inc.; "Safety Tree System" , H07163, dated Sep. 2009, 1 page.

Halliburton Energy Services Inc.; "Well Testing", H03884, dated Jul. 2004, 8 pages.

* cited by examiner

*Primary Examiner* — Nicole Coy
(74) *Attorney, Agent, or Firm* — Smith IP Services, P.C.

(57) ABSTRACT

A well system can include a tubular string in a blowout preventer stack, a releasable hanger of the tubular string supported by a support surface, and the released hanger permitting the tubular string to displace further through the blowout preventer stack. A tubular string can comprise a releasable hanger including at least one inwardly retractable support, an indicator sub interconnected a distance from the hanger, and wherein the support retracts in response to a stimulus, whereby the tubular string is released for displacement. A method of measuring a distance between a support surface and a location in a blowout preventer stack can include displacing a tubular string into the blowout preventer stack, contacting a releasable hanger with the surface, indicating the distance from the surface to the location along the tubular string, and then releasing the hanger, thereby permitting the tubular string to displace further through the blowout preventer stack.

30 Claims, 7 Drawing Sheets

REDUCING TRIPS IN WELL OPERATIONS

CROSS-REFERENCE TO RELATED APPLICATION

This application claims the benefit under 35 USC §119 of the filing date of International Application Serial No. PCT/US11/39841 filed 9 Jun. 2011. The entire disclosure of this prior application is incorporated herein by this reference.

BACKGROUND

This disclosure relates generally to equipment utilized and operations performed in conjunction with subterranean wells and, in an embodiment described herein, more particularly provides for reducing trips in well operations.

In a typical well testing operation, a separate trip is needed with a landing string to measure a distance between a wear bushing or hanger and a component of a blowout preventer stack. This is one example of a single-purpose trip which consumes valuable time and expense in a well operation.

Therefore, it will be appreciated that improvements are continually needed in the art of efficiently utilizing time and capital in well operations. These improvements can be useful in well testing and other types of well operations.

SUMMARY

In carrying out the principles of this disclosure, a well system and associated method are provided which bring improvements to the art of efficient utilization of resources in well operations. One example is described below in which multiple trips can be combined using the principles of this disclosure. Another example is described below in which a tubular string can be suspended with a hanger, and then the hanger can be released to allow the tubular string to be used for other purposes.

In one aspect, a well system is provided to the art by the disclosure below. The well system can include a tubular string positioned in a blowout preventer stack, with a releasable hanger of the tubular string being supported by a support surface. When released, the hanger permits the tubular string to displace further through the blowout preventer stack.

In another aspect, a tubular string is described below. The tubular string can include a releasable hanger comprising at least one inwardly retractable support which extends outwardly from the tubular string. An indicator sub is interconnected in the tubular string a distance from the releasable hanger. The support retracts in response to a predetermined stimulus, thereby releasing the tubular string for displacement.

In yet another aspect, a method of measuring a distance between a support surface and a location in a blowout preventer stack is provided to the art. The method can include displacing a tubular string into the blowout preventer stack, contacting a releasable hanger with the support surface, indicating the distance from the support surface to the location along the tubular string, and then releasing the releasable hanger, thereby permitting the tubular string to displace further through the blowout preventer stack.

These and other features, advantages and benefits will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

Figure 1:
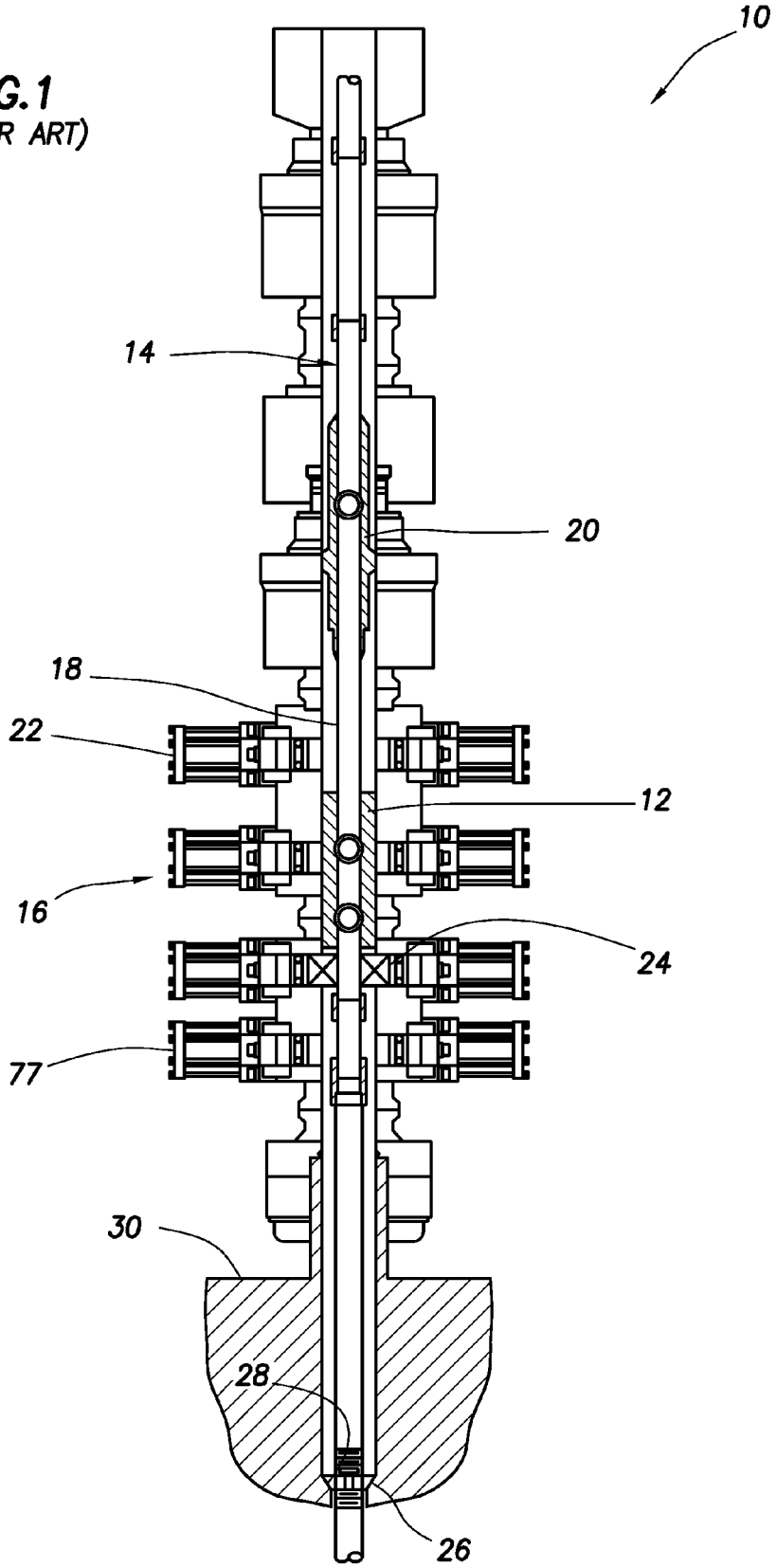
FIG. 1 (PRIOR ART)
FIGS. 1 & 2 are representative partially cross-sectional views of a prior art well system and associated method which can be improved on by utilizing the principles of this disclosure.

Representatively illustrated in FIG. 1 is a well system 10 and associated method which has been used in the past for subsea formation testing. A subsea test tree 12 is interconnected in a test string 14 positioned in a blowout preventer (BOP) stack 16. A shearable sub 18 is interconnected in the test string 14 between the test tree 12 and a retainer valve 20.

A sealing pipe ram 24 is closed against the test string 14 during a test, as depicted in FIG. 1. In an emergency, it may be necessary to close a shear ram 22 and thereby shear the sub 18, so that the test string 14 above the sheared sub can be quickly retrieved. Therefore, it will be appreciated that it is important to position the test string 14 precisely within the BOP stack 16, so that the ram 24 can seal effectively against the test string below the test tree 12, and so that the shearable sub 18 is positioned opposite the shear ram 22.

For this purpose, a fluted hanger 26 is typically interconnected in the test string 14. The fluted hanger 26 rests on a support surface 28 of a wellhead below the BOP stack 16. The fluted hanger 26 is axially adjustable relative to the test string 14, so that a spacing between the fluted hanger and the other components of the test string can be adjusted to match a spacing between the support surface 28 and the pipe ram 24, the shear ram 22, etc.

Unfortunately, the spacing between the support surface 28 and the pipe ram 24, the shear ram 22 and other components of the BOP stack 16 is typically not reliably known. For example, the support surface 28 could be formed on a wear bushing, or it could be formed on a casing or liner hanger, which may be one of multiple stacked hangers.

Figure 2:
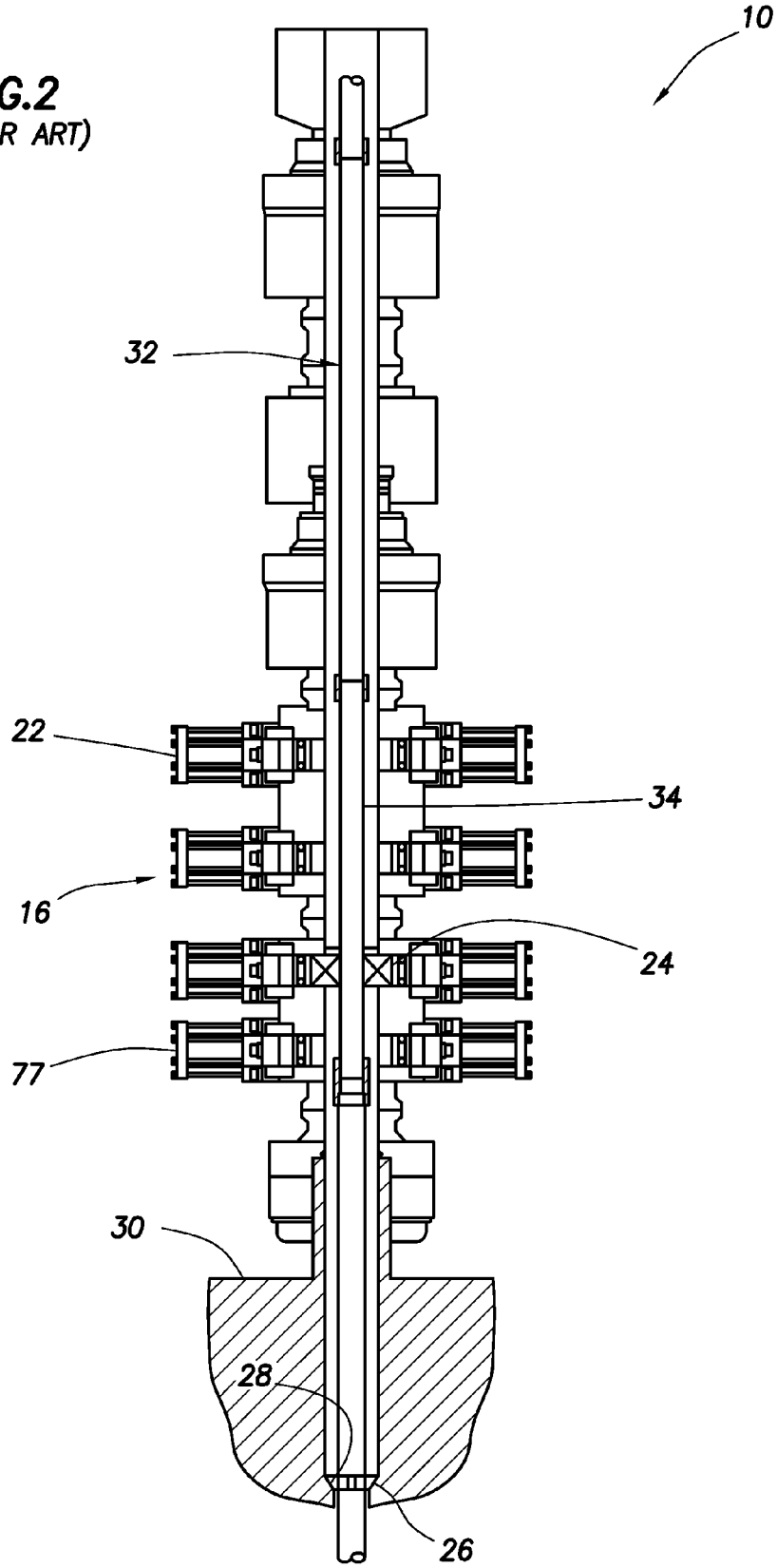
FIG.2 (PRIOR ART)

Due to this uncertainty as to the spacing between the support surface 28 and the components of the BOP stack 16, it is common practice to run a landing string 32 into the BOP stack, as depicted in FIG. 2, prior to running the test string 14. The landing string 32 includes the fluted hanger 26, but instead of the test tree 12, shearable sub 18, retainer valve 20, etc., the landing string includes a painted indicator sub 34.

After the fluted hanger 26 contacts the support surface 28 (and the position of the landing string 32 is, thus, fixed relative to the BOP stack 16), the pipe ram 24 is closed on the landing string, thereby identifiably marking the indicator sub 34. The landing string 32 is then retrieved (after opening the pipe ram 24), and the distance from the fluted hanger 26 to the mark on the indicator sub 34 is measured, thereby indicating the distance between the support surface 28 and the pipe ram 24.

Note that, since the fluted hanger 28 limits the downward displacement of the landing string 32 through the BOP stack 16, the landing string 32 cannot be used for additional purposes, such as installing completion equipment, placing pills, flowing treatment chemicals, etc., in the well below the wellhead 30. An additional one or more trips into the well will be necessary to accomplish such additional purposes, and it will be appreciated that additional trips increase the time and costs needed to complete well operations.

Figure 3:
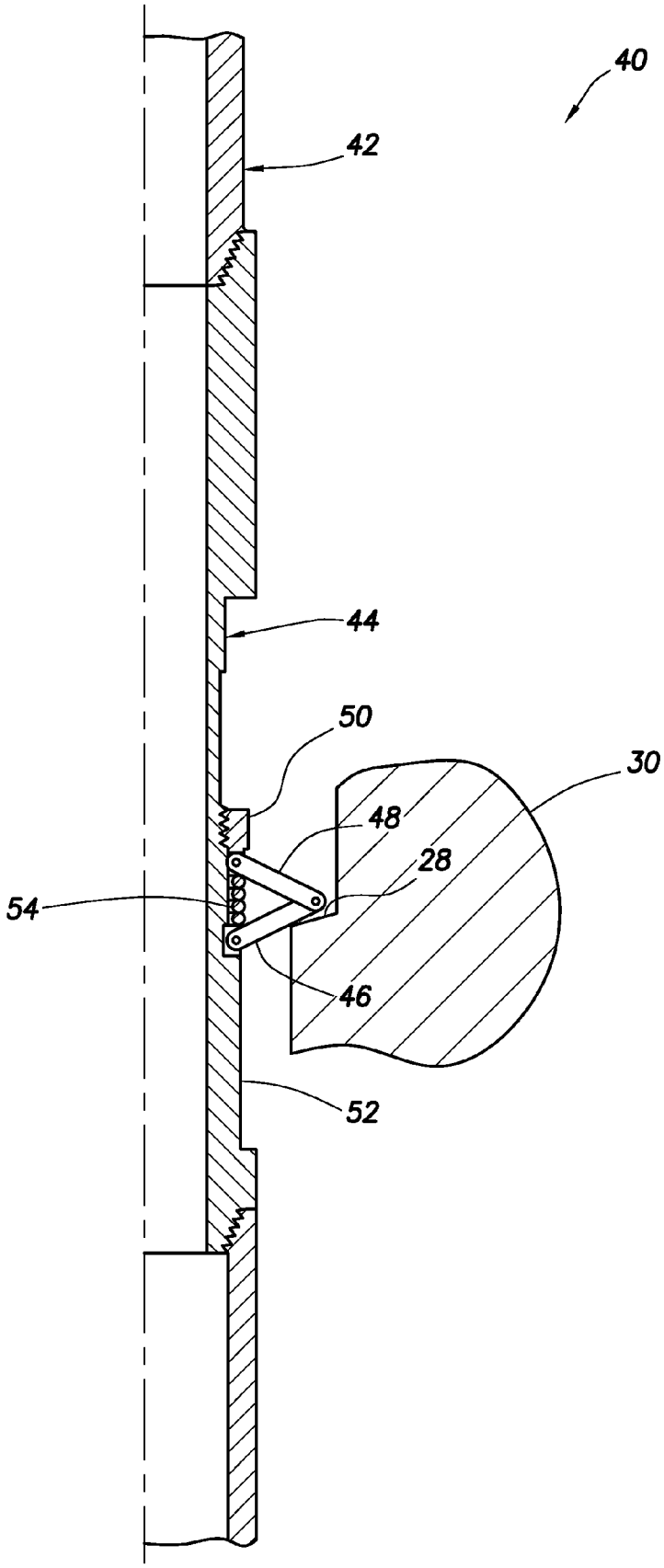
FIG. 3 is a representative quarter-sectional view of a well system and method which can embody principles of this disclosure.

Referring additionally now to FIG. 3, a well system 40 and associated method which can embody principles of this disclosure are representatively illustrated. The well system 40 is similar in some respects to the well system 10 of FIGS. 1 & 2, and so elements of the well system 40 which are similar to those described above are indicated in FIG. 3 using the same reference numbers.

In the well system 40, a tubular string 42 is lowered into the BOP stack 16 in a manner similar to the landing string 32 being installed in the BOP stack as depicted in FIG. 2. However, instead of the fluted hanger 26, the tubular string 42 has a releasable hanger 44 interconnected therein. The tubular string 42 is depicted in FIG. 3, along with the support surface 28, but the remainder of the well system is not shown in FIG. 3 for clarity of illustration.

The releasable hanger 44 includes one or more supports 46 which extend outwardly from the tubular string 42 to engage the support surface 28 and thereby fix the position of the tubular string relative to the BOP stack 16. The position of the tubular string 42 relative to the BOP stack 16 can then be indicated (such as, by closing the pipe ram 24 on the indicator sub 34 interconnected in the tubular string above the hanger 44, thereby marking the indicator sub).

Unlike the fluted hanger 26, the hanger 44 can then be released (e.g., by retracting the supports 46), so that the tubular string 42 can displace through the support surface 28, and further downward into the well. In this manner, the tubular string 42 can be used for additional purposes, such as, conveying completion equipment into the well, setting plugs and/or packers, spotting pills or chemicals, pickling tubulars, etc. At least one trip into the well is thereby saved, which reduces the operation's overall time and expense.

In the FIG. 3 example, the tubular string 42 is supported by the engagement between the support 46 and the support surface 28. However, after the tubular string 42 is rotated a certain amount, the support 46 will pivot inward, and the hanger 44 will be able to displace downward past the support surface 28.

An arm 48 is pivotably connected between the support 46 and a threaded sleeve 50. With the tubular string 42 supported by the engagement between the support 46 and the surface 28, rotation of the tubular string 42 will cause the sleeve 50 to rotate relative to a body 52 of the hanger 44. Eventually, the sleeve 50 will unthread from the body 52, thereby allowing the sleeve to displace upward, and pivoting the support 46 and arm 48 inward, aided by a biasing device 54 (such as a spring, etc.).

Figure 4A:
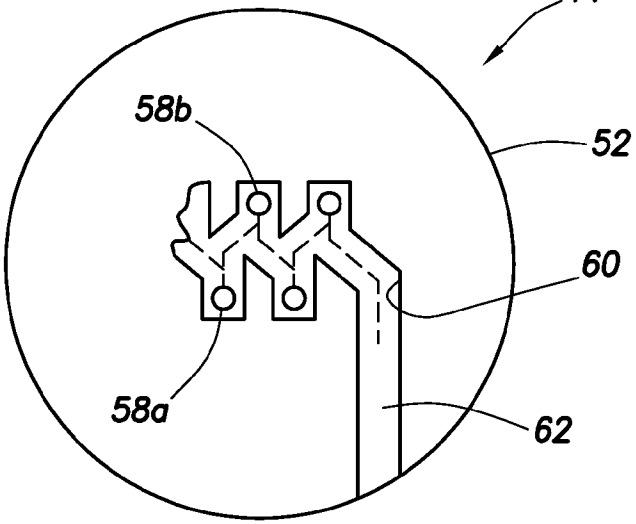
FIGS. 4-7 are representative quarter-sectional views of various configurations of a releasable hanger in the well system and method of FIG. 3.
Figure 4:
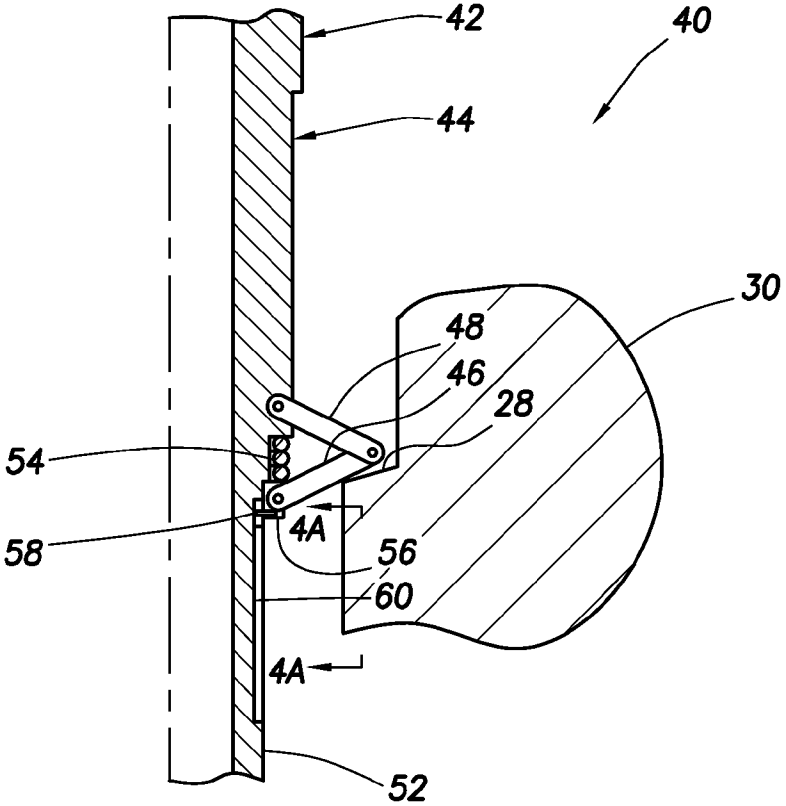

Referring additionally now to FIG. 4, another configuration of the releasable hanger 44 is representatively illustrated. In this example, the hanger 44 releases in response to reciprocation of the tubular string 42 relative to the surface 28.

The support 46 is pivotably connected to a sleeve 56 having an inwardly projecting pin 58. The pin 58 is engaged with a J-slot or ratchet profile 60 formed on the body 52. An enlarged view of the profile 60 is depicted in FIG. 4A.

The pin 58 traverses the profile 60 upwardly and downwardly as the tubular string 42 is reciprocated upwardly and downwardly, with an upward load being alternately applied to and released from the support 46 as it alternately contacts and disengages from the surface 28. For example, when the support 46 is disengaged from the surface 28, the pin 58 is positioned at a downward position 58*a*, and when the support is engaged with the surface and a sufficient load is applied to compress the device 54, the pin is positioned at an upward position 58*b*.

As shown in FIG. 4A, the pin 58 will gradually advance along the profile 60, until it reaches a release path 62. A subsequent raising of the hanger 44 relative to the surface 28 will allow the pin 58 to displace downward through the release path 62 (aided by a biasing force exerted by the device 54), thereby displacing the sleeve 56 downward, and pivoting the support 46 and arm 48 inward. At that point, the tubular string 42 can be lowered into the well past the surface 28.

Figure 5:
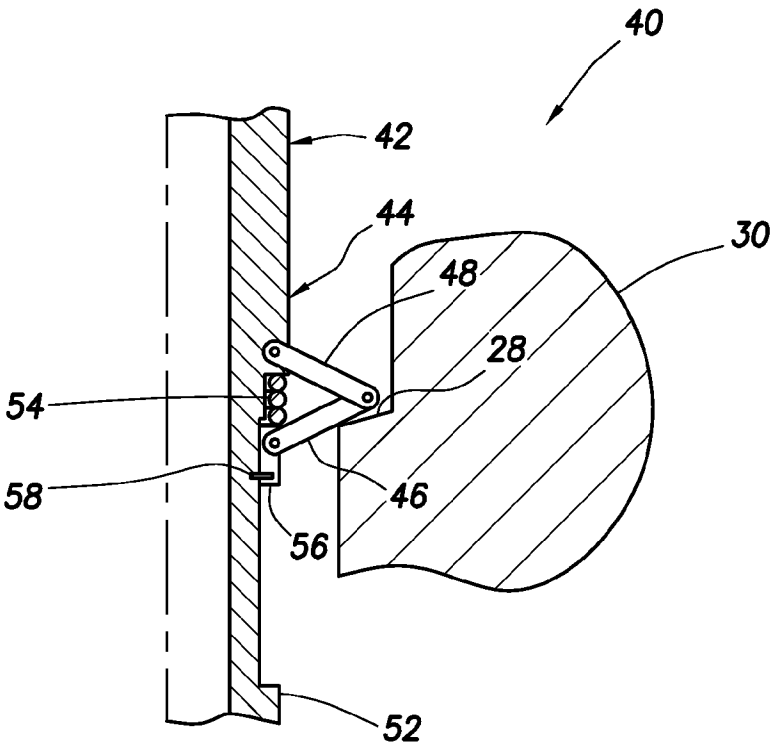

Referring additionally now to FIG. 5, another configuration of the releasable hanger 44 is representatively illustrated. This configuration is similar in many respects to the configuration of FIG. 4.

However, the configuration of FIG. 5 differs at least in that the pin 58 is not engaged with the profile 60. Instead, the pin 58 is rigidly retained relative to the body 52, so that the pin will shear when a predetermined load is applied to the pin.

The load can be applied by slacking off weight (e.g., applying a weight of the tubular string 42 to the surface 28), after the support 46 has engaged the surface 28. When the tubular string 42 is subsequently picked up, the sleeve 56 can displace downwardly relative to the body 52 (aided by the device 54), thereby pivoting the support 46 and arm 48 inward, so that the tubular string can pass downwardly past the surface 28.

Figure 6:
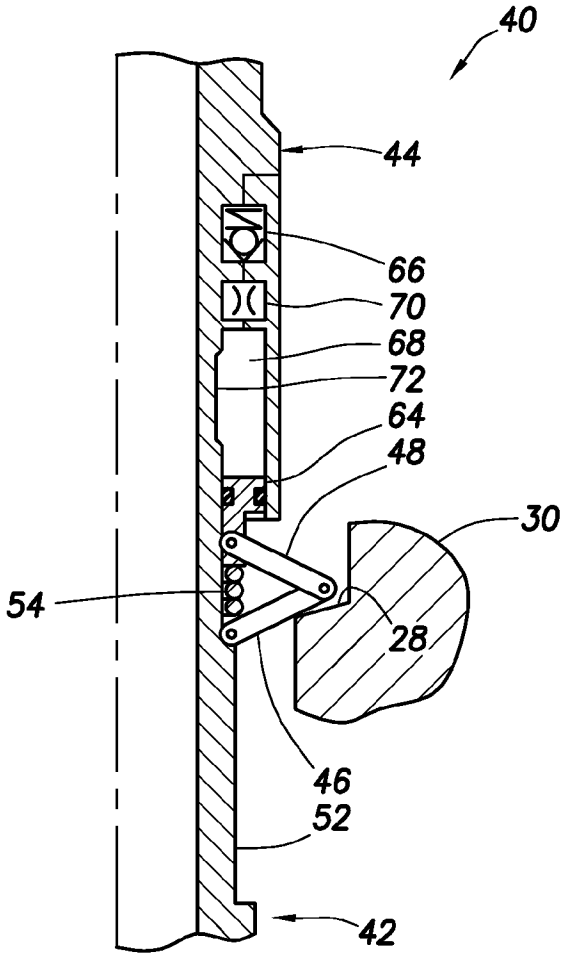

Referring additionally now to FIG. 6, another configuration of the releasable hanger 44 is representatively illustrated. In this configuration, the arm 48 is pivotably connected between the support 46 and a piston 64.

When a sufficient load is applied to the support 46 (e.g., by applying a certain weight of the tubular string 42 to the support 28), a relief valve 66 will open, thereby allowing fluid 68 to be metered through a restrictor 70. The fluid 68 is pressurized due to a force transmitted to the piston 64 via the support 46 and arm 48. Thus, the relief valve 66 opens when a predetermined load is applied to the support 46 and a corresponding pressure is thereby applied to the fluid 68.

Eventually, the piston 64 reaches a reduced diameter section 72 on the body 52. This relieves a pressure differential across the piston 64 and allows the piston to displace upward, aided by the biasing force of the device 54.

When the piston 64 displaces upward, the support 46 and arm 48 pivot inward. At this point, the hanger 44 is released, and the tubular string 42 can displace downward past the support 28.

Note that an amount of time required for the piston 64 to displace to the reduced diameter section 72 (and, thus, the amount of time between applying the predetermined load to the support 46 and release of the hanger 44) can be determined if the rate of flow of the fluid 68 through the relief valve 66 and restrictor 70 at the corresponding pressure differential is known. Therefore, the hanger 44 can be released a predetermined amount of time after the predetermined load is applied.

Figure 7:
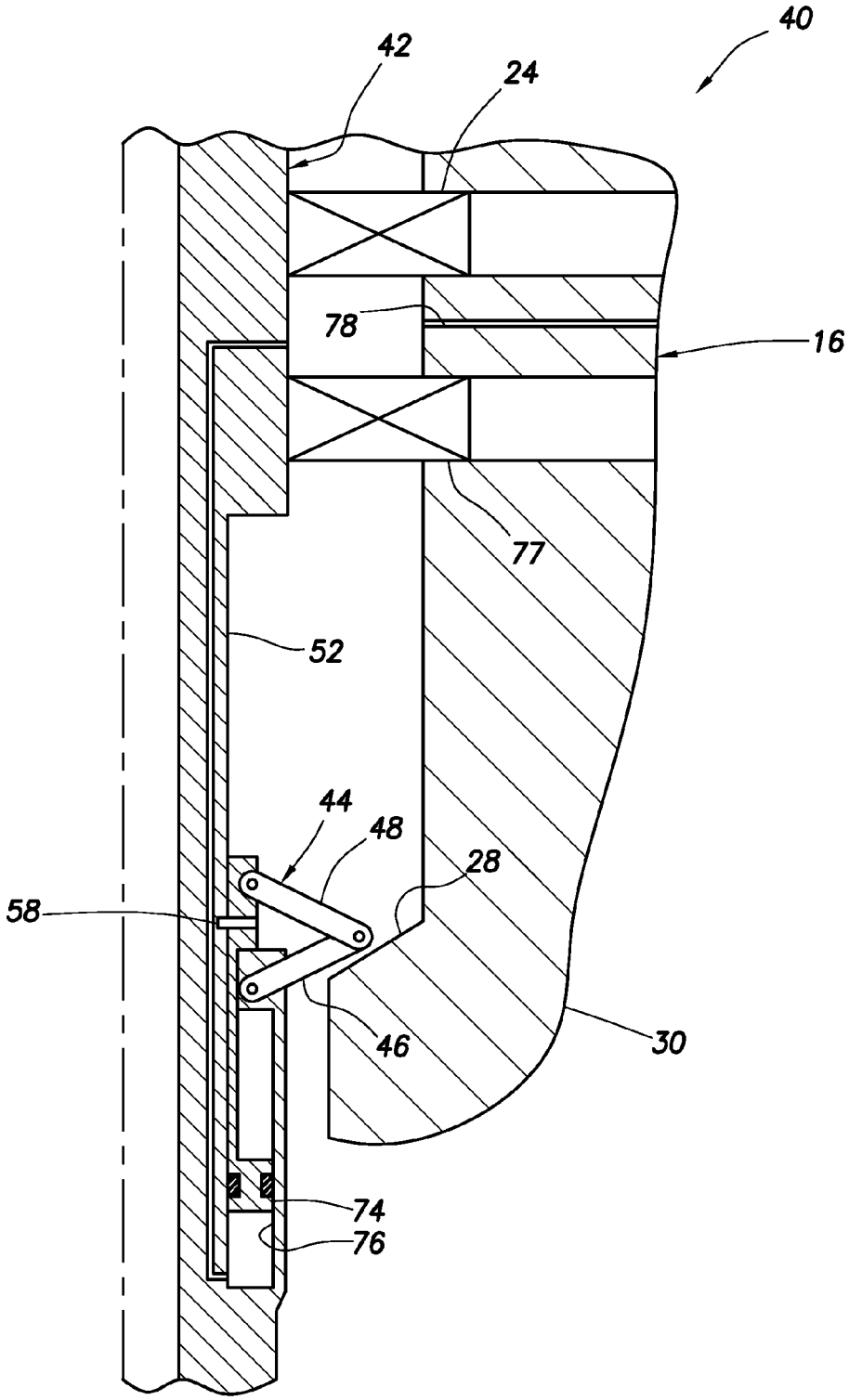

Referring additionally now to FIG. 7, another configuration of the releasable hanger 44 is representatively illustrated. In this configuration, the arm 48 is pivotably connected between the support 46 and a piston 74 which is secured by the pin 58 relative to the body 58.

Pressure is applied to a chamber 76 below the piston 74 by closing two sealing pipe rams 24, 77 and applying the pressure via a line 78 in communication with an annular space formed radially between the hanger 44 and the BOP stack 16, and axially between the pipe rams. When a predetermined pressure differential is applied across the piston 74, the pin 58 will shear, the piston will displace upwardly, and the support 46 and arm 48 will pivot inwardly. At this point, the hanger 44 can displace downward past the surface 28.

Figure 8:
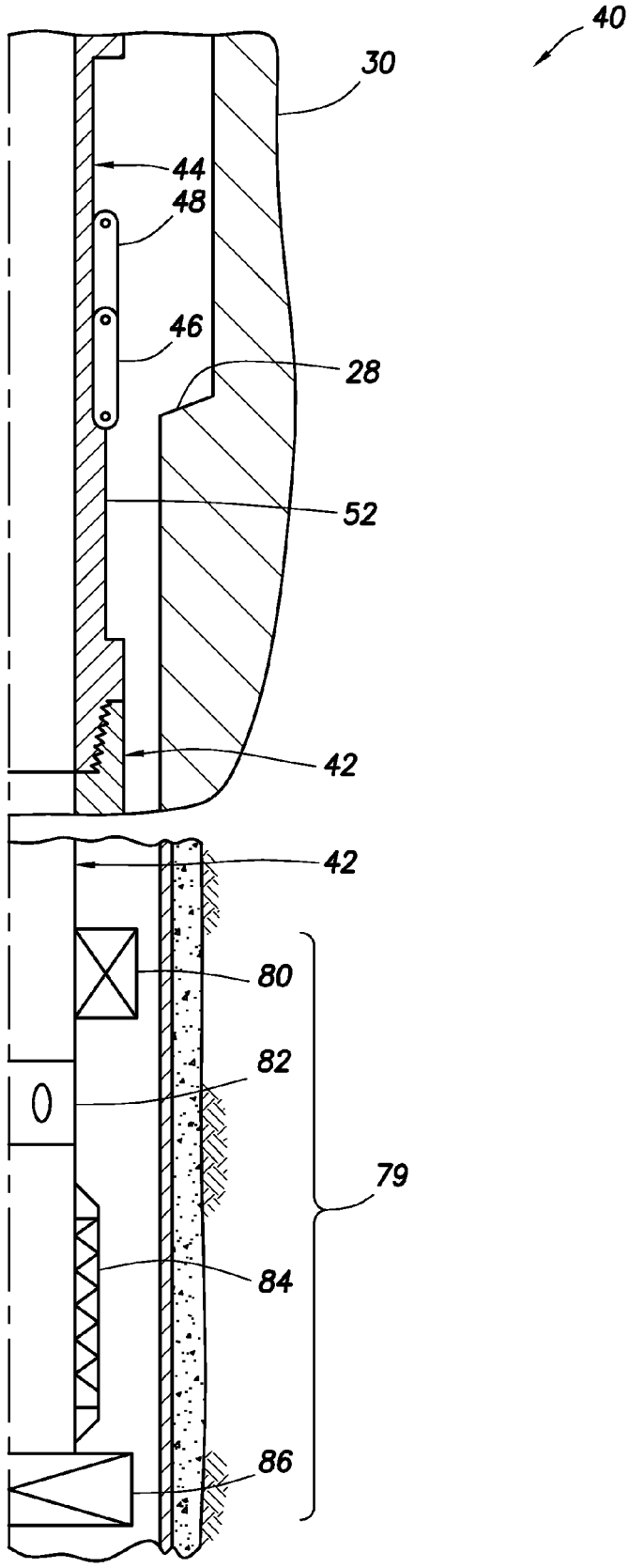
FIG. 8 is a representative quarter-sectional view of the well system and method of FIG. 3, after the hanger is released.

Referring additionally now to FIG. 8, the tubular string 42 is representatively illustrated after the hanger 44 has been released. Note that the support 46 is retracted inwardly, so that the hanger 44 and the rest of the tubular string 42 can displace downwardly further into the well.

Any of the releasing mechanisms described above and/or illustrated in FIGS. 3-7 may be used to release the hanger 44 of FIG. 8. Furthermore, any other type of releasable hanger may be used in keeping with the scope of this disclosure.

For example, hangers which release electrically, hydraulically, mechanically, optically, explosively, in response to telemetry signals, or by any other means can be used. The examples described above are provided to demonstrate that there is a wide variety of possible configurations for releasable hangers which may be used, and so the principles of this disclosure are not limited in any manner to the details of the examples described herein and/or depicted in the drawings.

The tubular string 42 illustrated in FIG. 8 has various items of completion equipment 79 interconnected below the releasable hanger 44. In this example, the completion equipment 79 includes a packer 80, a flow control device 82 (such as, a production valve, gravel packing valve, choke, etc.), a well screen 84 and a plug 86.

Of course, other components, fewer components and more components may be included in the completion equipment 79 in keeping with the scope of this disclosure. The packer 80, flow control device 82, screen 84 and plug 86 are used only as examples of various types of equipment which can be interconnected in the tubular string 42 below the releasable hanger 44.

Note that it is not necessary for completion equipment 79 to be connected below the releasable hanger 44. Other operations which can be performed after releasing the hanger 44 (and without the completion equipment 79) include placing chemical treatments, spotting gels, pickling tubing, etc. Thus, the ability to release the hanger 44 after indicating the distance between the support 28 and the components of the BOP stack 16 enables the tubular string 42 to be used for a variety of different purposes in the well below the wellhead 30, without requiring any additional trips to accomplish those purposes.

It may now be fully appreciated that the well system 40, tubular string 42 and releasable hanger 44 provide significant advancements to the art. The tubular string 42 can be used to measure the distance between the support surface 28 and the pipe ram 24 and/or other components of the BOP stack 16, without requiring a separate trip to perform the measurement.

In one aspect, the above disclosure provides to the art a well system 40 which can include a tubular string 42 positioned in a blowout preventer stack 16, and a releasable hanger 44 of the tubular string 42 supported by a support surface 28. The hanger 44 when released permits the tubular string 42 to displace further through the blowout preventer stack 16.

When released, the hanger 44 may further permit the releasable hanger 44 to displace through the support surface 28.

The well system 40 may also include a sealing ram 24 closed against the tubular string 42.

The hanger 44 may release in response to passage of a predetermined amount of time, application of a predetermined load to the hanger 44, reciprocation of the tubular string 42, rotation of the tubular string 42 and/or application of fluid pressure to the hanger 44. The fluid pressure may be applied between two sealing rams 24, 77 sealed against the tubular string 42.

The well system 40 may include at least one of a group comprising a packer 80, a plug 86, a flow control device 82, and a well screen 84 suspended below the hanger 44.

Also described above is a tubular string 42 which can include a releasable hanger 44 comprising at least one inwardly retractable support 46 which extends outwardly from the tubular string 42, and an indicator sub 34 interconnected in the tubular string 42 a known distance from the releasable hanger 44. The support 46 may retract in response to a predetermined stimulus, whereby the tubular string 42 is released for displacement.

Completion equipment 79 may be interconnected in the tubular string 42 opposite the releasable hanger 44 from the indicator sub 34. The completion equipment 79 can comprise a packer 80, a plug 86, a flow control device 82, and/or a well screen 84.

The support 46 may retract in response to passage of a predetermined amount of time, application of a predetermined load to the hanger 44, reciprocation of the tubular string 42, rotation of the tubular string 42, and/or application of fluid pressure to the hanger 44.

The support 46 may pivot relative to a body 52 of the releasable hanger 44 in response to the stimulus.

The indicator sub 34 may comprise a painted sub.

The above disclosure also describes a method of measuring a distance between a support surface 28 and a location in a blowout preventer stack 16. The method can include displacing a tubular string 42 into the blowout preventer stack 16, contacting a releasable hanger 44 with the support surface 28, indicating the distance from the support surface 28 to the location along the tubular string 42, and then releasing the releasable hanger 44, thereby permitting the tubular string 42 to displace further through the blowout preventer stack 16.

The releasing step may include permitting the releasable hanger 44 to displace through the support surface 28.

The indicating step may include closing a sealing ram 24 against the tubular string 42.

The releasing step may be performed in response to passage of a predetermined amount of time, application of a predetermined load to the hanger 44, reciprocation of the tubular string 42, rotation of the tubular string 42, and/or application of fluid pressure to the hanger 44. The fluid pressure may be applied between two sealing rams 24, 77 sealed against the tubular string 42.

The method may include suspending below the hanger 44 at least one of a packer 80, a plug 86, a flow control device 82, and a well screen 84.

It is to be understood that the various embodiments of this disclosure described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure.

Accordingly, the foregoing detailed description is to be clearly understood as being given by way of illustration and example only, the spirit and scope of the invention being limited solely by the appended claims and their equivalents.

What is claimed is:

1. A well system, comprising:

a tubular string positioned in a blowout preventer stack;

a releasable hanger of the tubular string supported by a support surface in a wellhead, and wherein the hanger when released permits the tubular string and the hanger to displace further downward through the blowout preventer stack.

2. The well system of claim 1, wherein the hanger when released further permits the releasable hanger to displace through the support surface.

3. The well system of claim 1, further comprising a sealing ram closed against the tubular string.

4. The well system of claim 1, wherein the hanger releases in response to passage of a predetermined amount of time.

5. The well system of claim 1, wherein the hanger releases in response to application of a predetermined load to the hanger.

6. The well system of claim 1, wherein the hanger releases in response to reciprocation of the tubular string.

7. The well system of claim 1, wherein the hanger releases in response to rotation of the tubular string.

8. The well system of claim 1, wherein the hanger releases in response to application of fluid pressure to the hanger.

9. The well system of claim 8, wherein the fluid pressure is applied between two sealing rams sealed against the tubular string.

10. The well system of claim 1, further comprising at least one of a group comprising a packer, a plug, a flow control device, and a well screen suspended below the hanger.

11. A tubular string, comprising:

a releasable hanger including at least one inwardly retractable support which extends outwardly from the tubular string;

an indicator sub interconnected in the tubular string a distance from the releasable hanger, and wherein the support retracts in response to a predetermined stimulus, whereby the tubular string is released for displacement.

12. The tubular string of claim 11, wherein completion equipment is interconnected in the tubular string opposite the releasable hanger from the indicator sub.

13. The tubular string of claim 12, wherein the completion equipment comprises at least one of a group comprising a packer, a plug, a flow control device, and a well screen.

14. The tubular string of claim 11, wherein the support retracts in response to passage of a predetermined amount of time.

15. The tubular string of claim 11, wherein the support retracts in response to application of a predetermined load to the hanger.

16. The tubular string of claim 11, wherein the support retracts in response to reciprocation of the tubular string.

17. The tubular string of claim 11, wherein the support retracts in response to rotation of the tubular string.

18. The tubular string of claim 11, wherein the support retracts in response to application of fluid pressure to the hanger.

19. The tubular string of claim 11, wherein the support pivots relative to a body of the releasable hanger in response to the stimulus.

20. The tubular string of claim 11, wherein the indicator sub comprises a painted sub.

21. A method of measuring a distance between a support surface and a location in a blowout preventer stack, the method comprising:

displacing a tubular string into the blowout preventer stack;

contacting a releasable hanger with the support surface;

indicating the distance from the support surface to the location along the tubular string; and then releasing the releasable hanger, thereby permitting the tubular string and the releasable hanger to displace further downward through the blowout preventer stack.

22. The method of claim 21, wherein the releasing step further comprises permitting the releasable hanger to displace through the support surface.

23. The method of claim 21, wherein the indicating step further comprises closing a sealing ram against the tubular string.

24. The method of claim 21, wherein the releasing step is performed in response to passage of a predetermined amount of time.

25. The method of claim 21, wherein the releasing step is performed in response to application of a predetermined load to the hanger.

26. The method of claim 21, wherein the releasing step is performed in response to reciprocation of the tubular string.

27. The method of claim 21, wherein the releasing step is performed in response to rotation of the tubular string.

28. The method of claim 21, wherein the releasing step is performed in response to application of fluid pressure to the hanger.

29. The method of claim 28, wherein the fluid pressure is applied between two sealing rams sealed against the tubular string.

30. The method of claim 21, further comprising suspending below the hanger at least one of a group comprising a packer, a plug, a flow control device, and a well screen.

* * * * *

UNITED STATES PATENT AND TRADEMARK OFFICE

CERTIFICATE OF CORRECTION

PATENT NO. : 8,397,827 B2
APPLICATION NO. : 13/369676
DATED : March 19, 2013
INVENTOR(S) : Paul D. Ringgenberg It is certified that error appears in the above-identified patent and that said Letters Patent is hereby corrected as shown below:

Title Page, below Item [65] insert
-- (30) Foreign Application Priority Data
9 June 2011 (WO) ..... PCT/US11/39841 --.

Signed and Sealed this
Eighteenth Day of February, 2014

Michelle K. Lee

Michelle K. Lee
*Deputy Director of the United States Patent and Trademark Office*